US009085446B1

(12) United States Patent
Dahs

(10) Patent No.: US 9,085,446 B1
(45) Date of Patent: Jul. 21, 2015

(54) PIVOTABLE AUTO LIFT

(76) Inventor: Richard A. Dahs, Norwalk, OH (US)

( * ) Notice: Subject to any disclaimer, the term of this patent is extended or adjusted under 35 U.S.C. 154(b) by 472 days.

(21) Appl. No.: 13/562,599

(22) Filed: Jul. 31, 2012

(51) Int. Cl.

| | |
|---|---|
| ***B66F 7/28*** | (2006.01) |
| ***B66F 7/00*** | (2006.01) |
| ***B66F 7/10*** | (2006.01) |
| *B66F 7/20* | (2006.01) |

(52) U.S. Cl.
CPC ... *B66F 7/00* (2013.01); *B66F 7/28* (2013.01); *B66F 7/10* (2013.01)

(58) Field of Classification Search
CPC ..... B66F 7/10; B66F 7/20; B66F 7/28; B66F 7/00; B66F 7/0625; B66F 5/02; B66F 5/04
USPC ..... 187/203, 205, 210, 213, 215, 219, 221; 414/742, 744.4, 744.6, 744.7, 744.3; 254/8 B, 2 B, 8 C, 2 C, 89 H, 93 H, 93 L
See application file for complete search history.

(56) References Cited

U.S. PATENT DOCUMENTS

| | | | | |
|---|---|---|---|---|
| 1,767,982 | A * | 6/1930 | Hollister | 187/217 |
| 2,503,428 | A * | 4/1950 | Weaver | 187/216 |
| 2,713,922 | A * | 7/1955 | Harrison | 187/219 |
| 2,962,980 | A | 12/1960 | Carrigan | |
| 3,315,764 | A | 4/1967 | Clarke | |
| 3,788,414 | A | 1/1974 | Netter | |
| 4,457,401 | A * | 7/1984 | Taylor et al. | 187/208 |
| 4,501,342 | A | 2/1985 | Murphy | |
| 4,585,198 | A * | 4/1986 | Chartier et al. | 248/352 |
| 5,330,315 | A | 7/1994 | Beattie et al. | |
| 5,702,222 | A | 12/1997 | Rosen | |
| 5,860,491 | A * | 1/1999 | Fletcher | 187/203 |
| 6,845,848 | B1 | 1/2005 | Kritzer | |
| 6,866,124 | B1 * | 3/2005 | Barkis | 187/213 |
| 7,150,073 | B2 * | 12/2006 | Stewart | 16/354 |
| 7,736,118 | B2 * | 6/2010 | Uratani et al. | 414/744.6 |
| 8,256,577 | B2 * | 9/2012 | Kritzer | 187/215 |
| 2004/0011594 | A1 * | 1/2004 | Stewart | 187/213 |
| 2011/0114420 | A1 * | 5/2011 | Henthorn | 187/219 |

* cited by examiner

*Primary Examiner* — Michael Mansen
*Assistant Examiner* — Stefan Kruer

(57) ABSTRACT

The pivotable auto lift is an improvement over post-based auto lifts, and includes an adaptor that engages onto an in-ground receiver such that the adaptor rotates thereon. A first post connects with a pivot adaptor to rotate about an in-ground receiver, whereas a second post connects to a cross-brace spanning between the first post and second post. The first post, the cross-brace, and the second post collectively rotate about a central axis of the first post, and are able to rotate a full 360 degrees. Both the first post and the second post include auto lifting members thereon. The auto lifting members each engage underneath of a vehicle, and from a particular side. The in-ground receiver is rigidly secured to the floor and sub-floor such that the pivot adaptor rests thereon, and is incapable of separating when fitted thereon.

8 Claims, 5 Drawing Sheets

PIVOTABLE AUTO LIFT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of auto lifts, more specifically, an automobile lift that pivots about a central axis.

Auto lifts are a staple of any garage or auto shop, and enable a vehicle to be lifted on the ground in order to access underneath the respective vehicle as is commonly needed when repairing parts located under said vehicle.

There have been a lot of auto lifts that engage a bottom of said vehicle in order to lift said vehicle upwardly for access there under. Some auto lifts utilize two opposing posts that are rigidly affixed to a ground surface and include lifting means thereon for raising and lowering a vehicle. Auto lifts utilizing vertical posts are limited in range of motion, which can be difficult in maneuvering vehicles in and around.

None of the prior art directed to post-based auto lifts teach a pivotable auto lift that rotates about a central vertical axis in order to provide ingress in between and egress from two opposing auto lift posts. The device of the present application provides a post-based auto lift that can rotate about a central axis such that the post and auto lift can rotate when needed for egress and ingress of a vehicle.

B. Discussion of the Prior Art

As will be discussed immediately below, no prior art discloses an auto lift that includes a first post that pivots about a central axis in order to enable the auto lifts to rotate with respect to said central axis; wherein a second post is rigidly affixed to a cross-brace that extends to the first post such that the first post, the second post and cross-brace all collectively rotate about the central axis of the first post; wherein a vehicle is driven in range or out of range of the first post and second post collectively; wherein both the first post and the second post include auto lifting members thereon, which engage a bottom of said vehicle in order to lift said vehicle; wherein each auto lifting member engages a particular side of said vehicle; wherein the first post attaches to a pivot adaptor that engages onto a fixed in-ground receiver; wherein the first post and pivot adaptor rotate with respect to the in-ground receiver in order to rotate in and out of an area where a vehicle may be lifted as needed; wherein the second post may align with an in-ground non-rotating receiver in order to secure and prevent rotational movement of the entire auto lift.

The Carrigan Patent (U.S. Pat. No. 2,962,980) discloses a runway for an automobile with a floor base mount and a pivoting support. However, the pivoting support does not enable an entire auto lift and post to rotate about a central axis.

The Netter Patent (U.S. Pat. No. 3,788,414) discloses a small vehicle lift having a swiveling base beneath the floor with a cantilever lifting arm. However, the swiveling base does not enable an entire auto lift to rotate about a pivot point.

The Rosen Patent (U.S. Pat. No. 5,702,222) discloses an electrically driven car lift apparatus for home use. However, the car lift does not provide a means of rotation about a pivot point.

The Kritzer Patent (U.S. Pat. No. 6,845,848) discloses a vehicle lift with adjustable outriggers. However, the vehicle lift does not rotate about a pivot point or central axis in order to provide egress or ingress of a vehicle between two opposing auto lifts.

The Clarke Patent (U.S. Pat. No. 3,315,764) discloses an automobile lift. However, the automobile lift does not include an adaptor that attaches to an auto lift and post extending there from, which enables the auto lift to rotate about a pivot point.

While the above-described devices fulfill their respective and particular objects and requirements, they do not describe an auto lift that includes a first post that pivots about a central axis in order to enable the auto lifts to rotate with respect to said central axis; wherein a second post is rigidly affixed to a cross-brace that extends to the first post such that the first post, the second post and cross-brace all collectively rotate about the central axis of the first post; wherein a vehicle is driven in range or out of range of the first post and second post collectively; wherein both the first post and the second post include auto lifting members thereon, which engage a bottom of said vehicle in order to lift said vehicle; wherein each auto lifting member engages a particular side of said vehicle; wherein the first post attaches to a pivot adaptor that engages onto a fixed in-ground receiver; wherein the first post and pivot adaptor rotate with respect to the in-ground receiver in order to rotate in and out of an area where a vehicle may be lifted as needed; wherein the second post may align with an in-ground non-rotating receiver in order to secure and prevent rotational movement of the entire auto lift. In this regard, the pivotable auto lift departs from the conventional concepts and designs of the prior art.

SUMMARY OF THE INVENTION

The pivotable auto lift is an improvement over post-based auto lifts, and includes a pivot adaptor that engages onto an in-ground receiver such that the adaptor rotates thereon. A first post connects with a pivot adaptor to rotate about an in-ground receiver, whereas a second post connects to a cross-brace spanning between the first post and second post. The first post, the cross-brace, and the second post collectively rotate about a central axis of the first post, and are able to rotate a full 360 degrees. Both the first post and the second post include auto lifting members thereon. The auto lifting members each engage underneath of a vehicle, and from a particular side. The in-ground receiver is rigidly secured to the floor and sub-floor such that the pivot adaptor rests thereon, and is incapable of separating when fitted thereon. The second post may align with an in-ground non-rotating receiver in order to secure and prevent rotational movement of the entire auto lift.

An object of the invention is to provide a post-based auto lift that is able to rotate a first post, a second post, a cross-brace, around a central axis of the first post as needed.

A further object of the invention is to provide a pivot adaptor and in-ground receiver that enable rotation there between with respect to the first post.

A further object of the invention is to provide an in-ground adaptor that is rigidly affixed to the floor and sub-floor.

An even further object of the invention is to include an in-ground non-rotating receiver for alignment and use with the second post such that the entire assembly may be locked in place when needed.

These together with additional objects, features and advantages of the pivotable auto lift will be readily apparent to those of ordinary skill in the art upon reading the following detailed description of presently preferred, but nonetheless illustrative, embodiments of the pivotable auto lift when taken in conjunction with the accompanying drawings.

In this respect, before explaining the current embodiments of the pivotable auto lift in detail, it is to be understood that the pivotable auto lift is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the pivotable auto lift.

It is therefore important that the claims be regarded as including such equivalent construction insofar as they do not depart from the spirit and scope of the pivotable auto lift. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
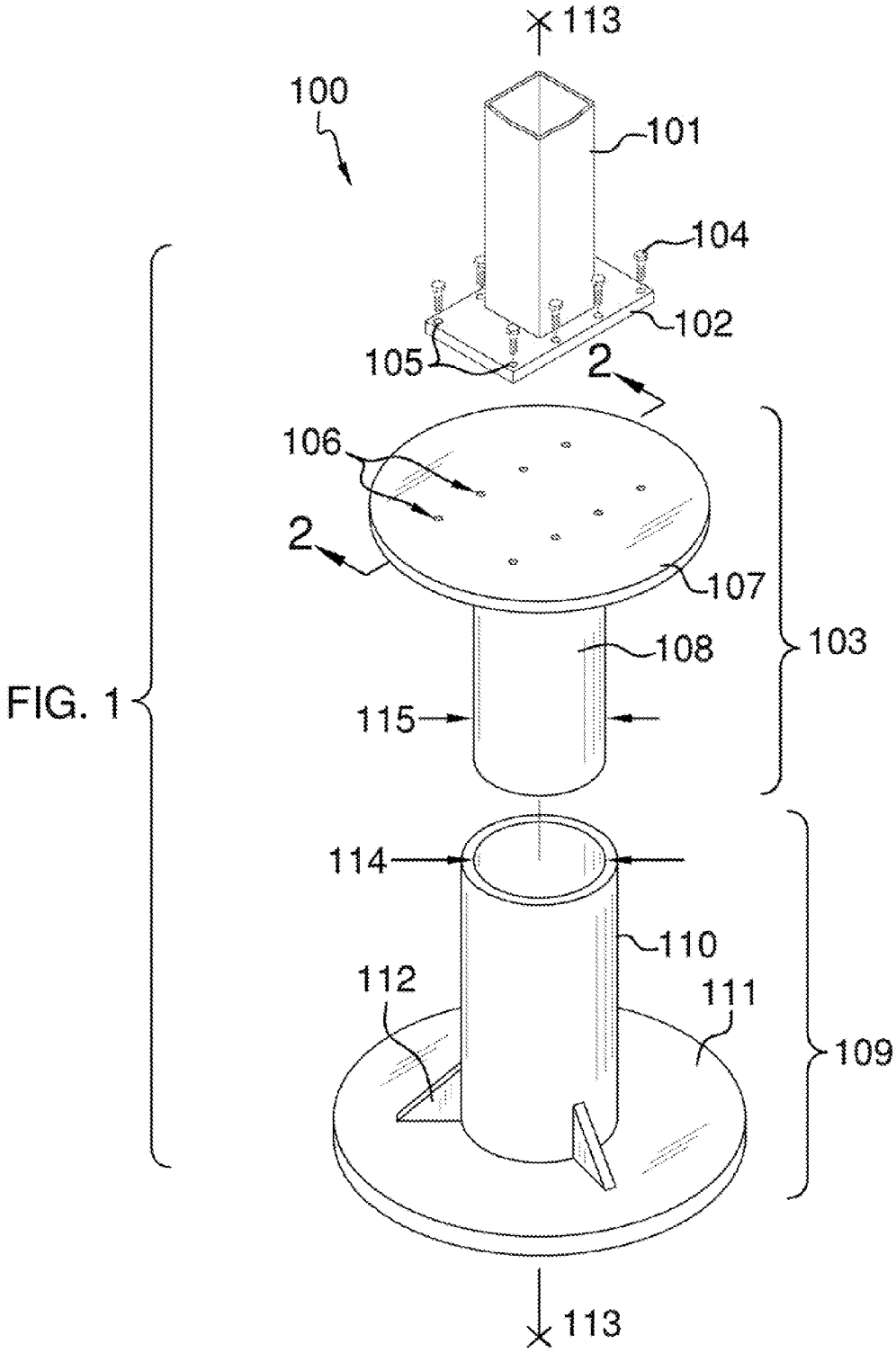
FIG. 1 illustrates a perspective view of the bottom portion of the first post, the pivot adaptor, and the in-ground receiver.
Figure 2:
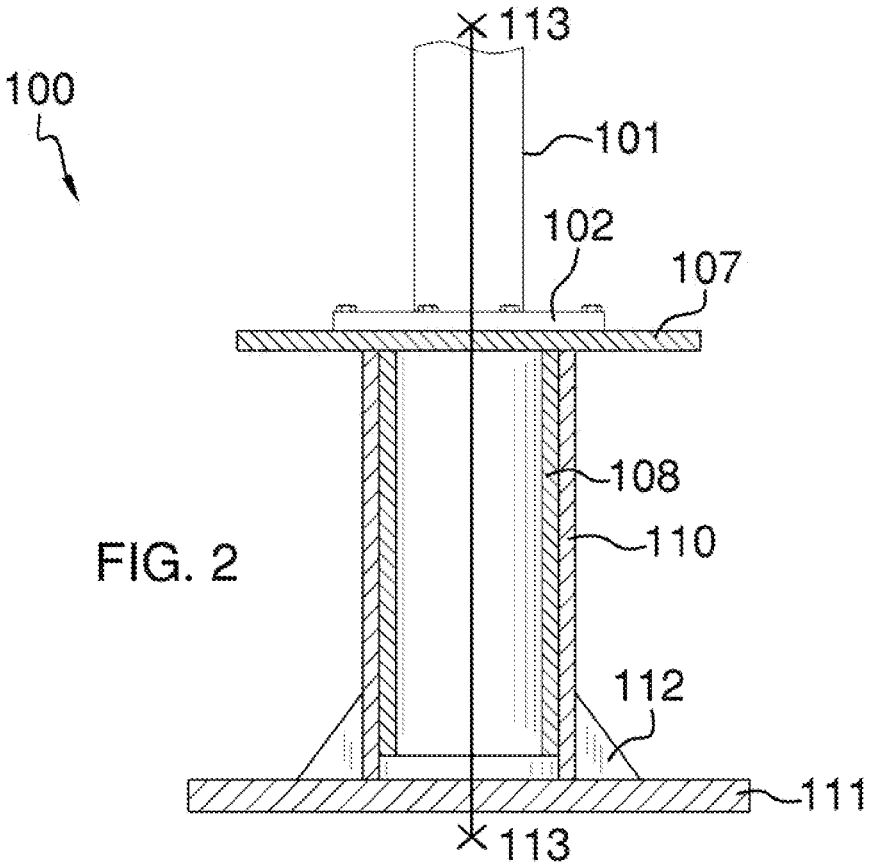
FIG. 2 illustrates a cross-sectional view of the pivotable auto lift along line 2-2 in FIG. 1, and detailing the pivot adaptor inserted into the in-ground receiver.
Figure 3:
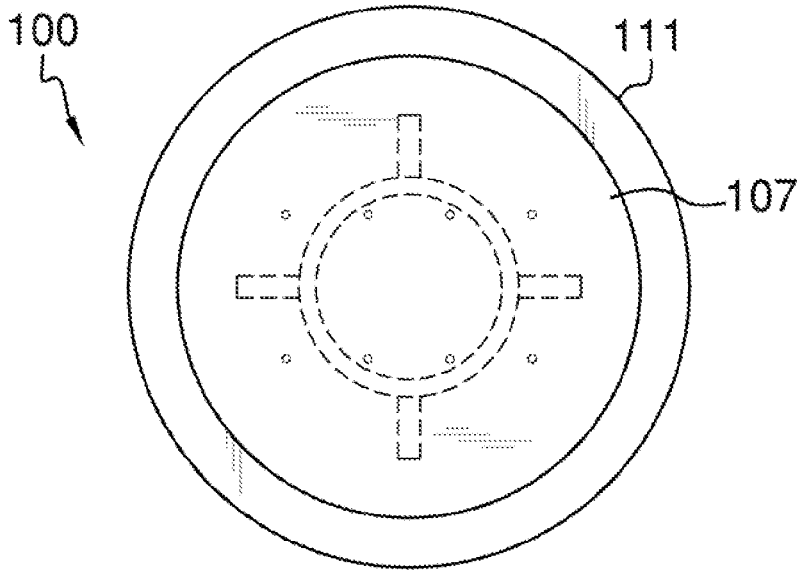
FIG. 3 illustrates a top view of the pivotable auto lift wherein hidden lines outline the location of the in-ground receiver and gussets.
Figure 4:
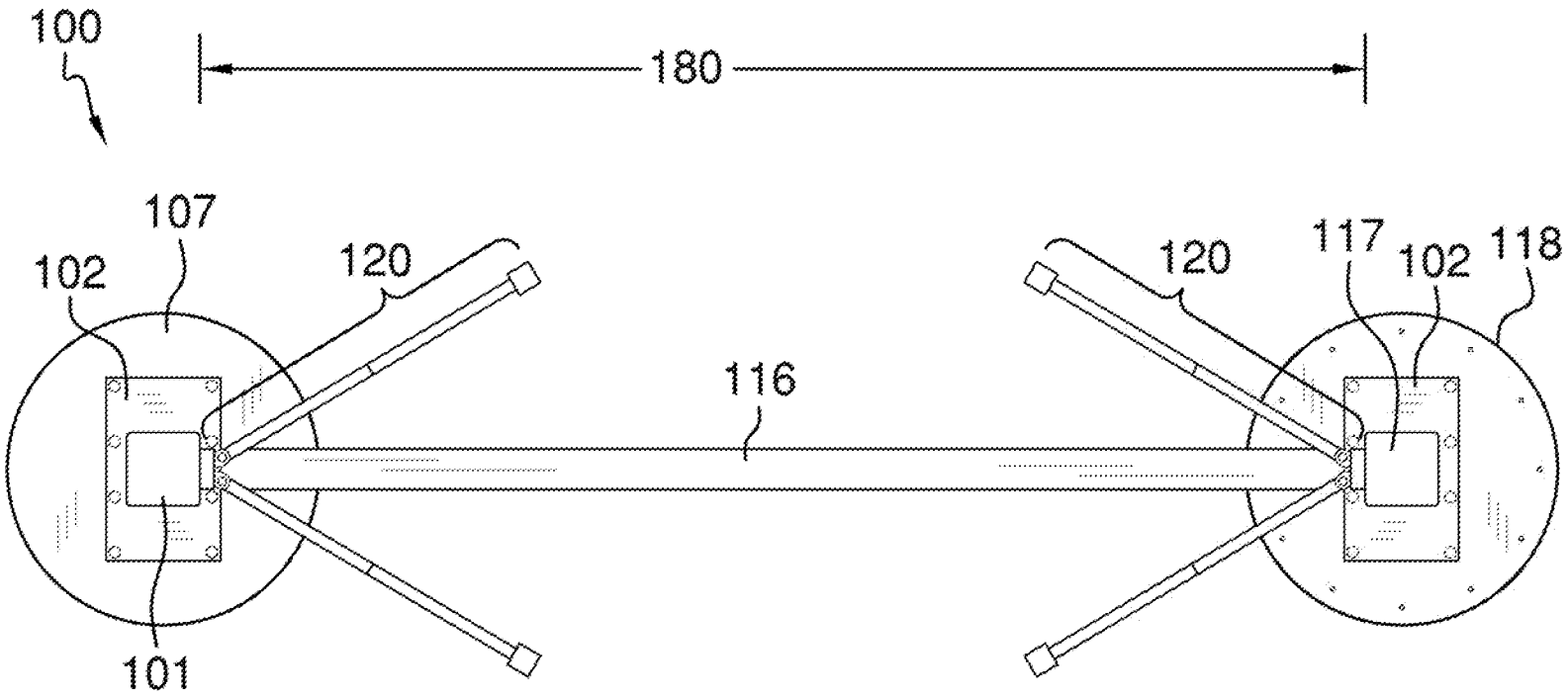
FIG. 4 illustrates a top view of the pivotable auto lift wherein the cross-brace extends between the first post and the second post.
Figure 5:
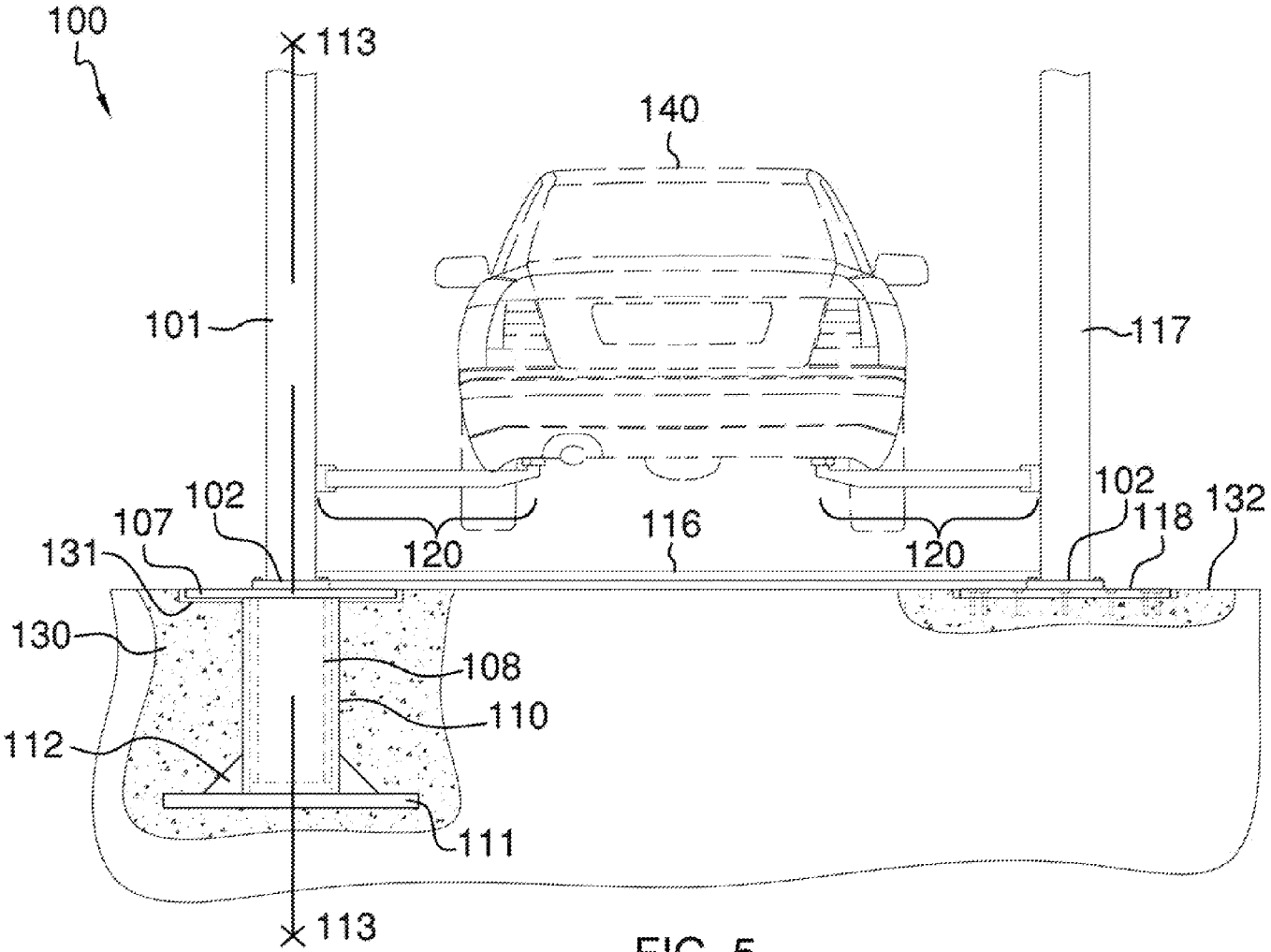
FIG. 5 illustrates a side detail view of the pivotable auto lift installed into a floor and sub-floor wherein the in-ground receiver is encased in the sub-floor, whereas the pivot adaptor rests therein and is able to freely rotate with respect to the in-ground receiver, and also detailing the non-rotating in-ground receiver for the second post.
Figure 6:
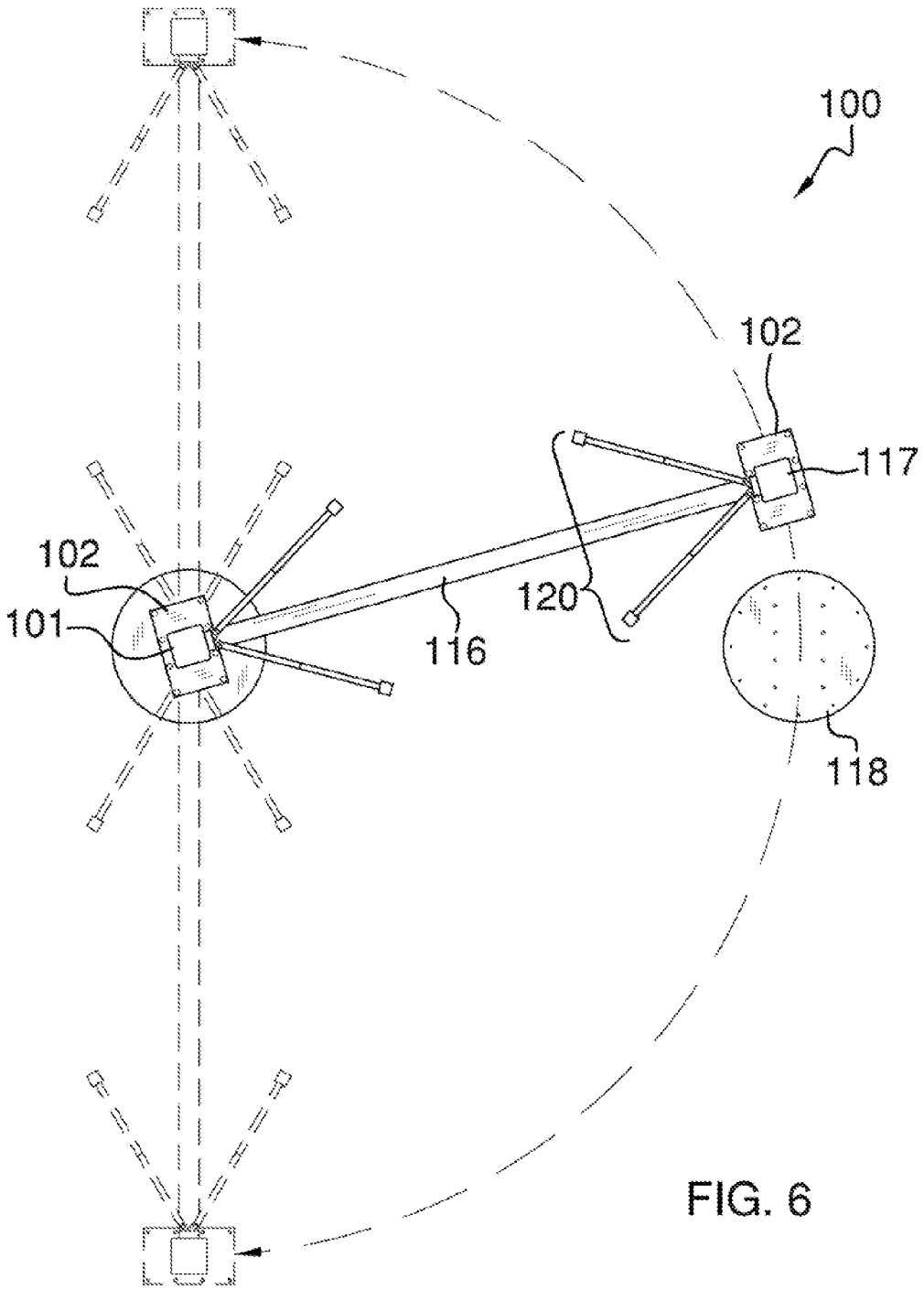
FIG. 6 illustrates a second top view of the pivotable auto lift wherein the cross-brace and second post are rotating with respect to the central axis of the first post.

Detailed reference will now be made to the preferred embodiment of the present invention, examples of which are illustrated in FIGS. 1-6. A pivotable auto lift 100 (hereinafter invention) includes a first post 101 of an undefined height, and including a post base 102, and which is secured to a pivot adaptor 103 via a plurality of bolts 104. The post base 102 includes an array of bolt holes 105 through which the bolts 104 shall pass, and threadably engage with threaded holes 106 provided on the pivot adaptor 103.

The pivot adaptor 103 is unique to the invention 100, and is comprised of a circular disc member 107 that is rigidly affixed atop of a hollowed cylinder member 108. The hollowed cylinder member 108 is of an unspecified diameter, and an undefined height. The circular disc member 107 includes the threaded holes 106 thereon such that the first post 101 and post base 102 are able to be bolted securely in place thereon.

The invention 100 also includes an in-ground receiver 109, which is also unique to the invention 100. The in-ground receiver 109 is constructed of a receiver cylinder 110 of an undefined diameter and an undefined length. The receiver cylinder 110 is rigidly affixed atop of a receiver plate 111. A plurality of gusset members 112 affix to an exterior of the receiver cylinder 110 and the receiver plate 111 in order to further rigidify the in-ground receiver 109.

It shall be noted that the receiver cylinder 110 is designed and oriented upwardly such that the hollowed cylinder member 108 of the pivot adaptor 103 slides therein from above. Moreover, the pivot adaptor 103 is designed to rest atop of and rotate about the in-ground receiver 109. The pivot adaptor 103 shall have a full 360 degrees of rotational movement about a central axis 113. The central axis 113 shall be centrally aligned through the first post 101, the pivot adaptor 103, and the in-ground receiver 109. The receiver cylinder 110 has an inner diameter 114 that is greater than an outer diameter 115 of the hollow cylinder member 108.

The in-ground receiver 109 shall be encased within a sub floor 130. That being said, it is envisioned that the in-ground receiver 109 is installed during the construction of the sub-floor 130, which is ideally made of a concrete. The sub-floor 130 may include a shoulder 131, which extends a depth to accommodate the pivot adaptor 103 when fitted onto the in-ground receiver 109 (see FIG. 5).

The invention 100 includes a cross-brace 116 that extends from the first post 101 to a second post 117. The second post 117 shall mirror in size and shape with respect to the first post 101. Thus, the second post 117 includes the post base 102, which is able to rotate across a floor surface 132. The entire invention 100 shall rotate about the central axis 113. The invention 100 shall include an in-ground non-rotating receiver 118, which is further defined as a circular receiver plate that includes an array of bolt holes 119 thereon for use with the post base 102 of the second post 117. The non-rotating receiver 118 enables the invention 100 to be secured in place, and thereby prevents rotation of the invention 100 about the central axis 113.

The cross-brace 116 is further defined with a cross-length 180, which defines the distance between the first post 101 and the second post 117. The cross-brace 116 is rigidly affixed to the first post 101 and the second post 117 just above the post bases 102, respectively, thus, the cross-brace 116 is a low lying member, and has a low profile such that the vehicle 140 can easily drive over the cross-brace 116. It shall be noted that the first post 101 and the second post 117 are generally parallel with one another.

Both the first post 101 and the second post 117 shall include auto lifting members 120 thereon, and which work to lift a vehicle 140 upwardly with respect to the sub floor 130. The auto lifting members 120 of the first post 101 and the second post 117 shall lift from underneath the vehicle 140, and from a respective side of the vehicle 140. The posts 101 and 117 may be of hollowed construction having a cross-sectional shape of a circle, triangle, or square.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A pivotable auto lift comprising:

a first post rotatable engaged about a central axis;

a second post connects to a cross-brace, which in turn connects with the first post;

wherein the first post, the second post, and the cross-brace rotate about the central axis of the first post;

wherein the first post and the second post each includes an auto lifting member affixed thereto, which member is able to raise and lower a vehicle up or down with respect to a floor surface;

wherein the first post and the second post are generally parallel with one another, and are separated by a cross distance that defines a length of the cross-brace;

wherein the first post and the second post each include a post base;

wherein the post base of the first post is bolted to a pivot adaptor;

wherein the pivot adaptor is comprised of a circular disc member that is rigidly affixed atop a hollow cylinder member; wherein the circular disc member includes threaded holes therein such that the first post and the respective post base are bolted securely in place thereon;

wherein an in-ground receiver is constructed of a receiver cylinder; wherein the receiver cylinder is rigidly affixed atop of a receiver plate; wherein a plurality of gusset members is affixed to an exterior of the receiver cylinder and the receiver plate to rigidify the in-ground receiver; wherein the receiver cylinder is oriented upwardly such that the hollow cylinder member of the pivot adaptor slides therein from above; wherein the pivot adaptor rests atop, and rotates about, the in-ground receiver;

wherein the pivot adaptor has a full 360 degrees of rotational movement about the central axis of the first post; and wherein the central axis is centrally aligned through the first post, the pivot adaptor, and the in-ground receiver.

2. The pivotable auto lift as described in claim 1 wherein the receiver cylinder has an inner diameter that is greater than an outer diameter of the hollow cylinder member.

3. The pivotable auto lift as described in claim 2 wherein the in-ground receiver is encased within a sub floor; wherein the sub-floor includes a shoulder, which extends to a depth to accommodate the pivot adaptor when fitted onto the in-ground receiver.

4. The pivotable auto lift as described in claim 3 wherein an in-ground, non-rotating receiver is included, which is further defined as a circular receiver plate that includes an array of bolt holes therein for use with the post base of the second post.

5. A pivotable auto lift comprising:

a first post rotatable engaged about a central axis;

a second post connected to a cross-brace, which is in turn connected with the first post;

wherein the first post, the second post, and the cross-brace rotate about the central axis of the first post;

wherein the first post and the second post each includes an auto lifting member affixed thereto, which member is able to raise and lower a vehicle up or down with respect to a floor surface;

wherein the first post and the second post are generally parallel with one another, and are separated by a cross distance that defines a length of the cross-brace;

wherein the first post and the second post each include a post base; wherein the post base of the first post is bolted to a pivot adaptor; wherein the pivot adaptor is comprised of a circular disc member that is rigidly affixed atop of a hollow cylinder member; wherein the circular disc member includes threaded holes therein such that the first post and the respective post base are bolted securely in place thereon;

wherein the receiver cylinder is rigidly affixed atop a receiver plate; wherein a plurality of gusset members is affixed to an exterior of the receiver cylinder and the receiver plate to rigidify the in-ground receiver; wherein the receiver cylinder is oriented upwardly such that the hollow cylinder member of the pivot adaptor slides therein from above; wherein the pivot adaptor rests atop of, and rotates about, the in-ground receiver;

wherein the pivot adaptor has a full 360 degrees of rotational movement about the central axis of the first post; and wherein the central axis is centrally aligned through the first post, the pivot adaptor, and the in-ground receiver.

6. The pivotable auto lift as described in claim 5 wherein the receiver cylinder has an inner diameter that is greater than an outer diameter of the hollow cylinder member.

7. The pivotable auto lift as described in claim 6 wherein the in-ground receiver is encased within a sub floor; wherein the sub-floor includes a shoulder, which extends to a depth to accommodate the pivot adaptor when fitted onto the in-ground receiver.

8. The pivotable auto lift as described in claim 7 wherein an in-ground, non-rotating receiver is included, which is further defined as a circular receiver plate that includes an array of bolt holes therein for use with the post base of the second post.

* * * * *